US010787855B2

(12) United States Patent
Nakatomi et al.

(10) Patent No.: US 10,787,855 B2
(45) Date of Patent: Sep. 29, 2020

(54) VEHICLE DOOR OPENING/CLOSING CONTROL DEVICE

(71) Applicant: TOYOTA JIDOSHA KABUSHIKI KAISHA, Toyota-shi, Aichi-ken (JP)

(72) Inventors: Noriaki Nakatomi, Miyoshi (JP); Tatsuya Shimizu, Okazaki (JP); Satoshi Yamane, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 181 days.

(21) Appl. No.: 16/052,118

(22) Filed: Aug. 1, 2018

(65) Prior Publication Data

US 2019/0048645 A1 Feb. 14, 2019

(30) Foreign Application Priority Data

Aug. 9, 2017 (JP) ..... 2017-154222

(51) Int. Cl.

| | |
|---|---|
| ***E06B 3/00*** | (2006.01) |
| ***E05F 15/75*** | (2015.01) |
| ***E05B 81/16*** | (2014.01) |
| ***E05B 81/14*** | (2014.01) |
| ***E05B 81/76*** | (2014.01) |
| ***E05B 85/10*** | (2014.01) |

(52) U.S. Cl.

CPC ..... *E05F 15/75* (2015.01); *E05B 81/14* (2013.01); *E05B 81/16* (2013.01); *E05B 81/76* (2013.01); *E05B 81/77* (2013.01); *E05B 85/10* (2013.01); *E05Y 2900/531* (2013.01)

(58) Field of Classification Search

CPC ..... E05F 15/75; E05B 81/76; E05B 81/77; E05B 81/16; E05B 81/14; E05B 85/10; E05Y 2900/531; B60R 25/24; G07C 9/00174

USPC ..... 49/503

See application file for complete search history.

(56) References Cited

U.S. PATENT DOCUMENTS

| | | | | |
|---|---|---|---|---|
| 7,055,997 | B2 * | 6/2006 | Baek | B60Q 1/2669 362/100 |
| 7,375,299 | B1 * | 5/2008 | Pudney | E05B 81/78 200/61.62 |
| 8,701,353 | B2 * | 4/2014 | Patel | E05B 85/107 49/503 |
| 8,943,752 | B2 * | 2/2015 | Thomas | E05B 85/10 49/394 |

(Continued)

FOREIGN PATENT DOCUMENTS

| | | |
|---|---|---|
| JP | 2007-162459 A | 6/2007 |
| JP | 2016-125339 A | 7/2016 |

*Primary Examiner* — Jerry E Redman

(74) *Attorney, Agent, or Firm* — Oliff PLC

(57) ABSTRACT

The controller detects an operation determined according to a detection result from a handle sensor that detects at least one of contact by, or the approach of, a hand of an operator. The controller performs control so as to actuate a door lock actuation section and unlock the door lock in cases in which the door lock is in a locked state, a pre-registered electronic key has been authenticated by an authentication section, and a predetermined first operation has been detected. The controller performs control so as to actuate a door latch actuation section and release the door latch in cases in which the door lock is in an unlocked state and a predetermined second operation has been detected.

13 Claims, 11 Drawing Sheets

(56) References Cited

U.S. PATENT DOCUMENTS

| | | | | |
|---|---|---|---|---|
| 9,050,943 | B2 * | 6/2015 | Muller | B60R 25/246 |
| 9,487,140 | B2 * | 11/2016 | Linden | B60Q 1/323 |
| 9,670,702 | B2 * | 6/2017 | Sugita | E05B 81/77 |
| 9,909,344 | B2 * | 3/2018 | Krishnan | E05B 81/82 |
| 10,006,229 | B2 * | 6/2018 | Beck | E05B 81/90 |
| 10,280,658 | B2 * | 5/2019 | Halliwell | E05B 85/107 |
| 10,501,967 | B2 * | 12/2019 | Brown | E05B 85/107 |
| 10,590,677 | B2 * | 3/2020 | Papanikolaou | H05B 6/10 |
| 2003/0001729 | A1 * | 1/2003 | Ieda | B60R 25/246 340/426.1 |
| 2003/0122556 | A1 * | 7/2003 | Sueyoshi | B60R 25/246 324/686 |
| 2004/0177478 | A1 * | 9/2004 | Louvel | E05B 81/78 16/430 |
| 2004/0217601 | A1 * | 11/2004 | Garnault | E05B 81/78 292/336.3 |
| 2007/0132552 | A1 | 6/2007 | Kurpinski et al. | |
| 2008/0061933 | A1 * | 3/2008 | Ieda | B60R 25/246 340/5.72 |
| 2008/0250607 | A1 * | 10/2008 | Ito | E05B 81/78 16/412 |
| 2011/0025522 | A1 * | 2/2011 | Peschl | H03K 17/955 340/686.6 |
| 2011/0260831 | A1 * | 10/2011 | Ieda | B60R 25/246 340/5.64 |
| 2013/0076048 | A1 * | 3/2013 | Aerts | E05B 85/103 292/336.3 |
| 2014/0230329 | A1 * | 8/2014 | Patel | E05B 83/36 49/25 |
| 2016/0189460 | A1 | 6/2016 | Watanabe et al. | |
| 2017/0002589 | A1 * | 1/2017 | Toyama | E05B 85/16 |

* cited by examiner

VEHICLE DOOR OPENING/CLOSING CONTROL DEVICE

CROSS-REFERENCE TO RELATED APPLICATION

This application is based on and claims priority under 35 USC 119 from Japanese Patent Application No. 2017-154222 filed on Aug. 9, 2017 the disclosure of which is incorporated by reference herein.

BACKGROUND

Technical Field

The present disclosure relates to a vehicle door control device that controls the opening/closing of vehicle doors.

Related Art

A vehicle door includes a door lock and a door latch. The door is locked and unlocked using the door lock, and the door can be opened by releasing the door latch when the door lock is in an unlocked state. Although locking and unlocking a door lock using electronic key authentication is well known, to release a door latch an operator typically operates a mechanical latch mechanism.

Technology for "hands free" unlocking and opening of vehicle doors has been proposed. For example, in the technology described by Japanese Patent Application Laid-Open (JP-A) No. 2007-162459 (Patent Document 1), when an electronic key ID is authenticated by a smart ECU, the door lock of a vehicle door being approached by a user is placed in an "unlock standby mode". Based on the door lock being placed in the unlock standby mode, a laser transceiver emits a laser beam, and when a portion of the body of the user, such as a foot, enters a region illuminated by the laser beam, the amount of reflected laser beam light received by the laser transceiver changes. A door lock ECU unlocks the door lock based on this change, and a door opening ECU releases the latch of the vehicle door, allowing the vehicle door to be popped open.

SUMMARY

However, in the technology of Patent Document 1, to open a front door, an operator needs to manually actuate a mechanical mechanism so as to release a latch. Further, although it is possible to unlock the door locks and release the door latches of the rear doors, door lock actuation sections for actuating door locks cannot be actuated separately to door latch actuation sections for actuating door latches, and there is therefore room for improvement.

In consideration of the above circumstances, an object of the present disclosure is to provide a vehicle door opening/closing control device capable of controlling a door lock actuation section separately to a door latch actuation section.

In a first aspect, a vehicle door opening/closing control device includes a door lock actuation section, a door latch actuation section, an authentication section, a lock instruction section, a latch instruction section, and a controller. The door lock actuation section actuates a door lock. The door latch actuation section actuates a door latch. The authentication section authenticates an electronic key of an operator. The lock instruction section detects at least one of an approach of or contact by a hand of the operator and instructs actuation of the door lock. The latch instruction section is provided separately from the lock instruction section, detects at least one of an approach of or contact by the hand of the operator, and instructs actuation of the door latch. The controller performs lock control so as to actuate the door lock actuation section in accordance with instruction from the lock instruction section in cases in which a pre-registered electronic key has been authenticated by the authentication section. The controller also performs latch control so as to actuate the door latch actuation section in accordance with instruction from the latch instruction section in cases in which the door lock is in an unlocked state.

In the first aspect, the door lock actuation section actuates the door lock and the latch instruction section is provided separately to the lock instruction section and actuates the door latch.

The authentication section authenticates an electronic key held by an operator. For example, the authentication section acquires identification information pre-stored in an electronic key via wireless communication or the like, and then authenticates whether or not the electronic key is a pre-registered electronic key.

The lock instruction section detects at least one of the approach of, or contact by, a hand of an operator and instructs actuation of the door lock. Namely, the lock instruction section enables the door lock to be locked and unlocked by the touch of a hand of the operator.

The latch instruction section detects at least one of the approach of, or contact by, a hand of an operator, and instructs actuation of the door latch. Namely, the latch instruction section enables the door latch to be released by the touch of a hand of the operator, and release of the door latch allows the door to be opened.

The controller performs lock control so as to actuate the door lock actuation section in accordance with instruction from the lock instruction section in cases in which a pre-registered electronic key has been authenticated by the authentication section, thereby enabling the door lock to be locked and unlocked by an occupant holding a pre-registered electronic key. Further, the controller performs latch control so as to actuate the door latch actuation section in accordance with instruction from the latch instruction section in cases in which the door lock is in an unlocked state, thereby enabling release of the door latch and allowing the vehicle door to be opened. The door lock actuation section is thereby able to be controlled separately to the door latch actuation section.

In a second aspect, a vehicle door opening/closing control device includes a door lock actuation section, a door latch actuation section, an authentication section, a detection section, and a controller. The door lock actuation section actuates a door lock. The door latch actuation section actuates a door latch. The authentication section authenticates an electronic key of an operator. The detection section detects an operation determined according to at least one of contact by or an approach of a hand of the operator. The controller performs control so as to actuate the door lock actuation section and unlock the door lock in cases in which the door lock is in a locked state, a pre-registered electronic key has been authenticated by the authentication section, and a predetermined first operation has been detected based on a detection result from the detection section. The controller also performs control so as to actuate the door latch actuation section and release the door latch in cases in which the door lock is in an unlocked state, and a predetermined second operation has been detected based on a detection result from the detection section.

In the second aspect, the door lock actuation section actuates the door lock and the door latch actuation section actuates the door latch The authentication section authenticates an electronic key held by an operator. For example, the authentication section acquires identification information pre-stored in an electronic key via wireless communication or the like, and then authenticates whether or not the electronic key is a pre-registered electronic key.

The detection section detects an operation determined according to at least one of contact by, or the approach of, a hand of an operator.

The controller performs control so as to actuate the door lock actuation section and unlock the door lock in cases in which the door lock is in a locked state, a pre-registered electronic key has been authenticated by the authentication section, and a predetermined first operation has been detected based on a detection result from the detection section, thereby enabling the door lock to be locked and unlocked by an occupant holding a pre-registered electronic key. Further, the controller performs control so as to actuate the door latch actuation section and release the door latch in cases in which the door lock is in an unlocked state, and a predetermined second operation has been detected based on a detection result from the detection section, thereby enabling release of the door latch and allowing the vehicle door to be opened. The door lock actuation section is thereby able to be controlled separately to the door latch actuation section. Moreover, a reduction in a number of components is possible since the door lock actuation section and the door latch actuation section are able to be controlled using a single detection section.

Note that as in a third aspect, the controller may further perform control so as to actuate the door lock actuation section and lock the door lock in cases in which the door lock is in an unlocked state and a predetermined third operation has been detected based on a detection result from the detection section. This allows the door lock to be transitioned from an unlocked state to a locked state without an increase in a number of components. As in a fourth aspect, the third operation may be the same as the first operation or the second operation. This simplifies lock control and allows a door lock to be placed into a locked state by an easy-to-understand operation.

As in a fifth aspect, the controller may further perform control so as to actuate the door lock actuation section and unlock the door lock, and so as to actuate the door latch actuation section and release the door latch, in cases in which the door lock is in a locked state, a pre-registered electronic key has been authenticated by the authentication section, and a predetermined fourth operation has been detected based on a detection result from the detection section. It is thereby possible to unlock the door lock and release the door latch with a single operation.

Further, as in a sixth aspect, in cases in which the door lock is in a locked state, a pre-registered electronic key has been authenticated by the authentication section, and the first operation has been detected, the controller may perform control so as to actuate the door lock actuation section of a vehicle door where the detection section that detected the first operation is provided and unlock the door lock, and in cases in which the door lock is in a locked state, a pre-registered electronic key has been authenticated by the authentication section, and a predetermined fifth operation has been detected, the controller may perform control so as to actuate the door lock actuation sections of all vehicle doors and unlock the door locks. This allows the unlocking of the door lock of a single vehicle door to be performed separately to the unlocking the door locks of all vehicle doors.

Note that as in a seventh aspect, the detection section may be provided at an outside handle. This enables a smooth transition to an opening/closing operation of the vehicle door after unlocking the door locks.

As described above, the present disclosure has the advantageous effect of enabling a vehicle door opening/closing control device capable of controlling a door lock actuation section separately to a door latch actuation section to be provided.

BRIEF DESCRIPTION OF THE DRAWINGS

Exemplary embodiments of the present invention will be described in detail based on the following figures, wherein.

DETAILED DESCRIPTION

Detailed explanation follows regarding examples of exemplary embodiments of the present disclosure, with reference to the drawings.

First Exemplary Embodiment

Figure 1:
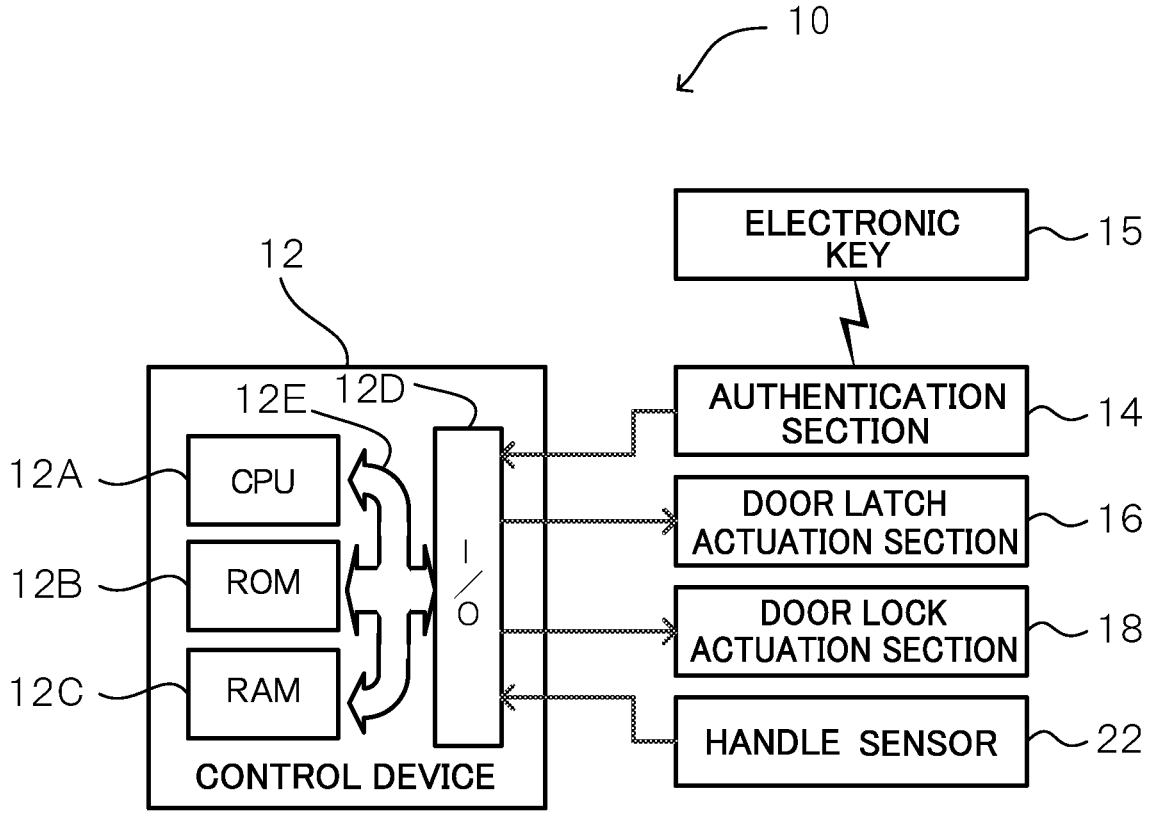
FIG. 1 is a block diagram illustrating the schematic configuration of a vehicle door opening/closing control device according to a first exemplary embodiment.
Figure 2A:
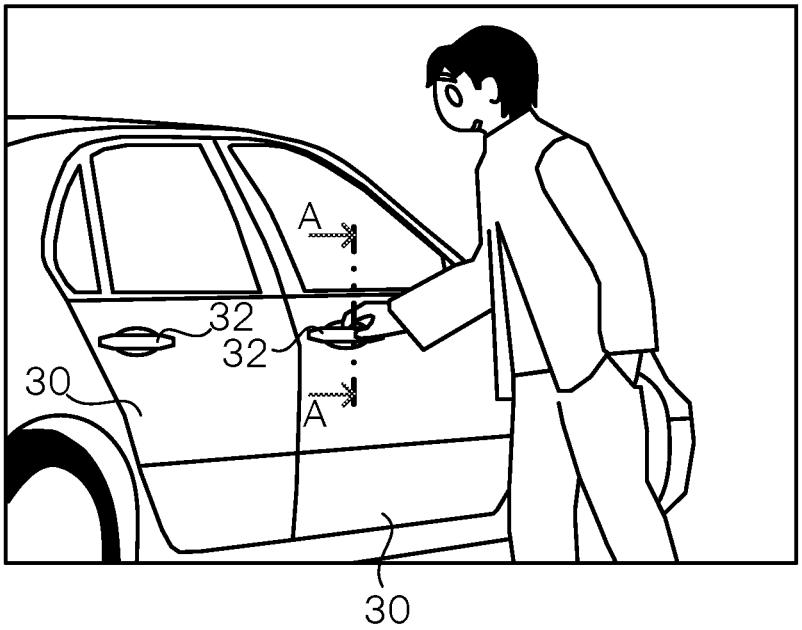
FIG. 2A is a diagram illustrating a state in which an operator has placed a hand on an outside handle of a vehicle door.
Figure 2B:
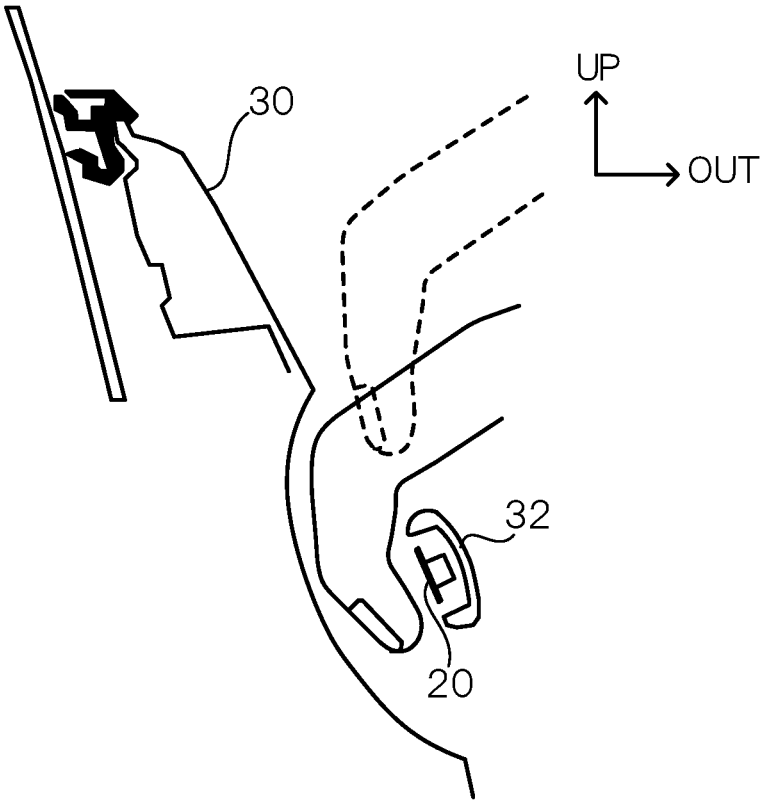
FIG. 2B is a diagram illustrating a cross-section taken along A-A in FIG. 2A.
Figure 3A:
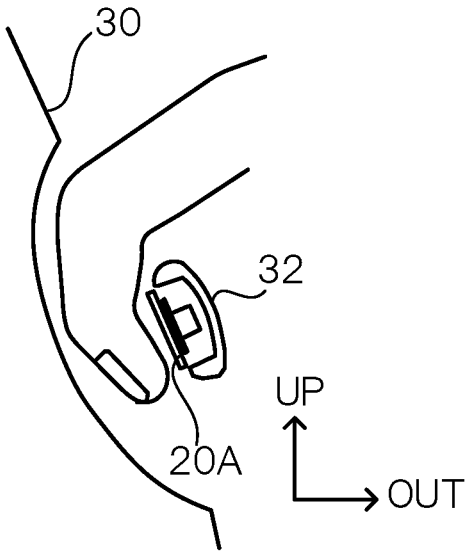
FIG. 3A is a diagram illustrating an example in which a handle sensor is a pressure sensor or a strain sensor.
Figure 3B:
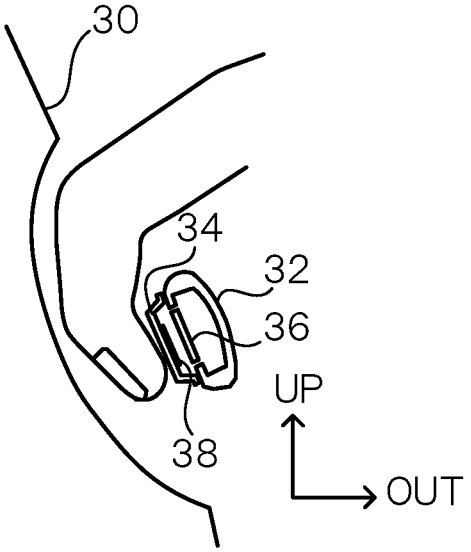
FIG. 3B a diagram illustrating an example in which a handle sensor is a capacitive sensor.
Figure 3C:
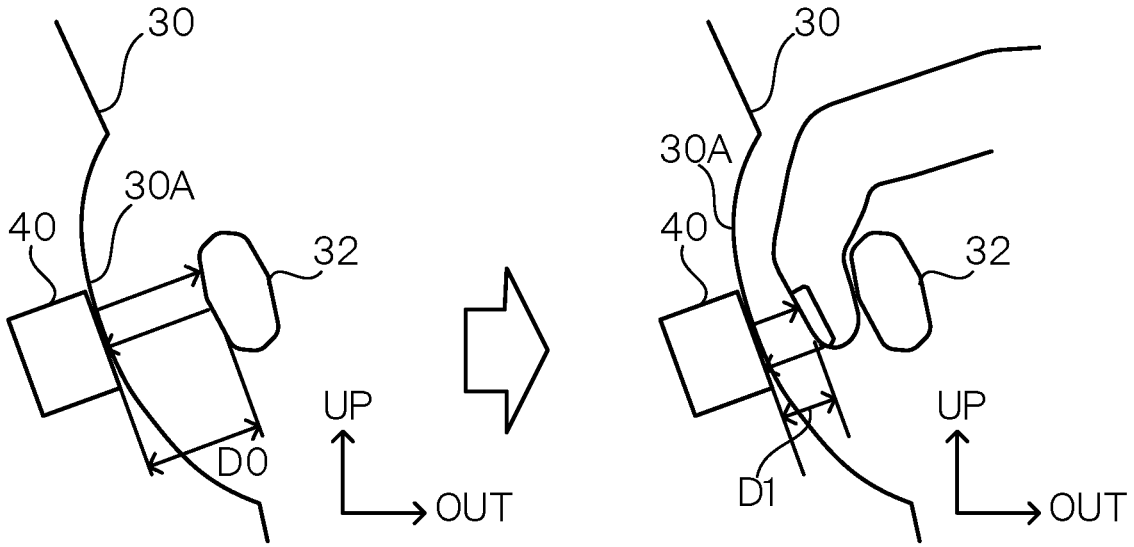
FIG. 3C is a diagram illustrating an example in which a handle sensor is a millimeter wave radar.
Figure 3D:
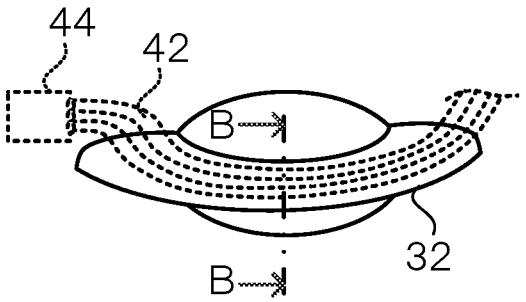
FIG. 3D is a diagram illustrating an example in which a handle sensor detects a change in pressure.
Figure 3E:
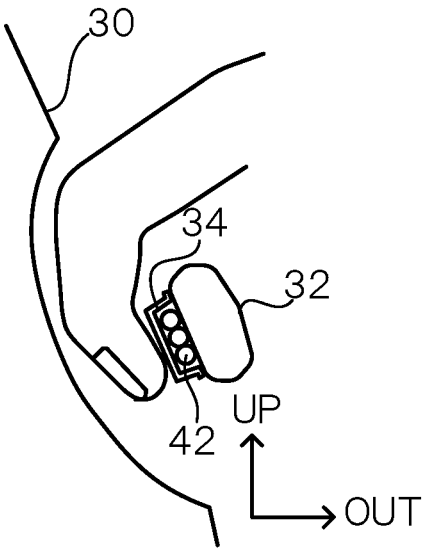
FIG. 3E is a diagram illustrating a cross-section taken along B-B in FIG. 3D.

FIG. 1 is a block diagram illustrating the schematic configuration of a vehicle door opening/closing control device according to an exemplary embodiment. FIG. 2A is a diagram illustrating a state in which an operator has placed a hand on an outside handle of a vehicle door, and FIG. 2B is a diagram illustrating a cross-section taken along A-A in FIG. 2A. FIG. 3A is a diagram illustrating an example in which a handle sensor is a pressure sensor or a strain sensor. FIG. 3B is a diagram illustrating an example in which a handle sensor is a capacitive sensor. FIG. 3C is a diagram illustrating an example in which a handle sensor is a millimeter wave radar. FIG. 3D is a diagram illustrating an example in which a handle sensor detects a change in pressure. FIG. 3E is a diagram illustrating a cross-section taken along B-B in FIG. 3D. Note that in FIG. 2 and FIG. 3, "UP" indicates an upper side of the vehicle, and "OUT" indicates an outer side in a vehicle width direction.

As illustrated in FIG. 1, a vehicle door opening/closing control device 10 according to the present exemplary embodiment includes an authentication section 14, a door latch actuation section 16, a door lock actuation section 18, a handle sensor 20 that serves as a detection section, and a control device 12 that serves as a controller.

The control device 12 is configured by a microcomputer in which a central processing unit (CPU) 12A, read-only memory (ROM) 12B, random-access memory (RAM) 12C, and an I/O (input/output interface) 12D are each connected to a bus 12E.

The authentication section 14, the door latch actuation section 16, the door lock actuation section 18, and the handle sensor 20 are each connected to the I/O 12D. A program or the like for controlling opening/closing of vehicle doors is stored in the ROM 12B of the control device 12. The RAM 12C is, for example, used as working memory for the CPU 12A to perform various calculations. Note that although one each of the door latch actuation section 16 and the door lock actuation section 18 are illustrated in FIG. 1, the door latch actuation section 16 and the door lock actuation section 18 are provided in correspondence with the vehicle doors. For example, four each of the door latch actuation sections 16 and the door lock actuation sections 18 are provided when there are four doors.

The authentication section 14 performs an authentication by detecting an electronic key 15 held by an operator, and then communicates the authentication result to the control device 12. The electronic key 15 is what is known as a smart key. Authentication of the electronic key 15 is performed by the authentication section 14 acquiring identification information pre-stored in the electronic key 15 using, for example, a type of wireless communication protocol and then authenticating whether or not the electronic key is a pre-registered electronic key.

The door latch actuation section 16 actuates a door latch provided to a vehicle door using a motor, for example, so as to release the door latch and place the vehicle door in an openable state.

The door lock actuation section 18 actuates a door lock provided to a vehicle door using a motor, for example, so as to lock or unlock the door lock.

As illustrated in FIG. 2A and FIG. 2B, the handle sensor 20 is provided to an outside handle 32 of a vehicle door 30. The handle sensor 20 detects at least one of contact by, or the approach of, the hand of an operator at the vehicle inner side of the outside handle 32, and outputs a detection result to the control device 12. Various touch sensors, for example a capacitive or an optical touch sensor, may be employed as the handle sensor 20. Another example of the handle sensor 20A may employ a sensor such as a pressure sensor or a strain sensor. For example, as illustrated in FIG. 3A, a sensor 20A, in this case a pressure sensor or a strain sensor, may be provided at a vehicle inner side portion of the outside handle 32 that is contacted by a finger of an operator. Alternatively, as illustrated in FIG. 3B, the outside handle 32 may be provided with a cover 34 configured by an elastic member such as rubber, with a capacitive sensor 36 provided in the outside handle 32 and a dielectric 38 provided to the cover 34. Configuration may be such that a change in capacitance (a change in the distance between electrodes) is detected. Providing the cover 34 enables the erroneous detection of something other than the touch of a hand, such as rain, to be prevented. Alternatively, as illustrated in FIG. 3C, a range sensor 40, such as a millimeter wave radar or a light-emitting and -receiving element, may be provided within the vehicle door 30, so as to detect a change in a distance (D0-D1) reflected from the outside handle 32 back to the outside handle 32. Note that in cases in which millimeter wave radar is employed, a cup portion 30A of the outside handle 32 is made with resin. Alternatively, as illustrated in FIG. 3D and FIG. 3E, a cover 34 configured by an elastic member such as rubber may be provided to the outside handle 32, pressure-detecting tubes 42 may be provided between the cover 34 and the outside handle 32, and pressure change due to the pressure-detecting tubes 42 being made to flex by a finger is detected by a pressure measurement section 44.

In the present exemplary embodiment, the control device 12 is configured to detect plural types of operations based on detection results from the handle sensor 20. Namely, the control device 12 detects operations determined by at least one of contact by, or the approach of, the hand of an operator. In the present exemplary embodiment, the method to differentiate plural types of operations is, for example, a method in which operation type is differentiated according to the length of time the hand of an operator is in contact with the handle sensor 20.

Figure 4A:
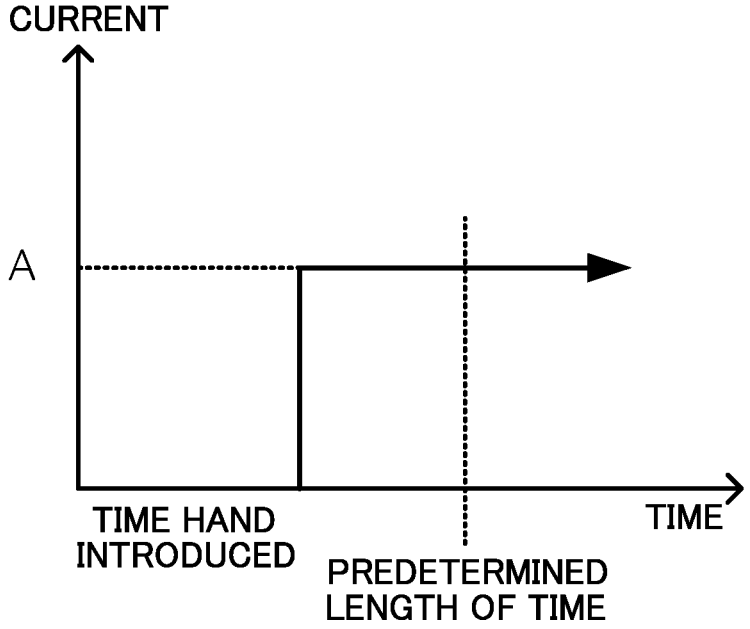
FIG. 4A is a diagram illustrating an example of detection values in a case in which a handle sensor continuously detects the hand of an operator for at least a predetermined length of time after initially detecting the hand of the operator.
Figure 4B:
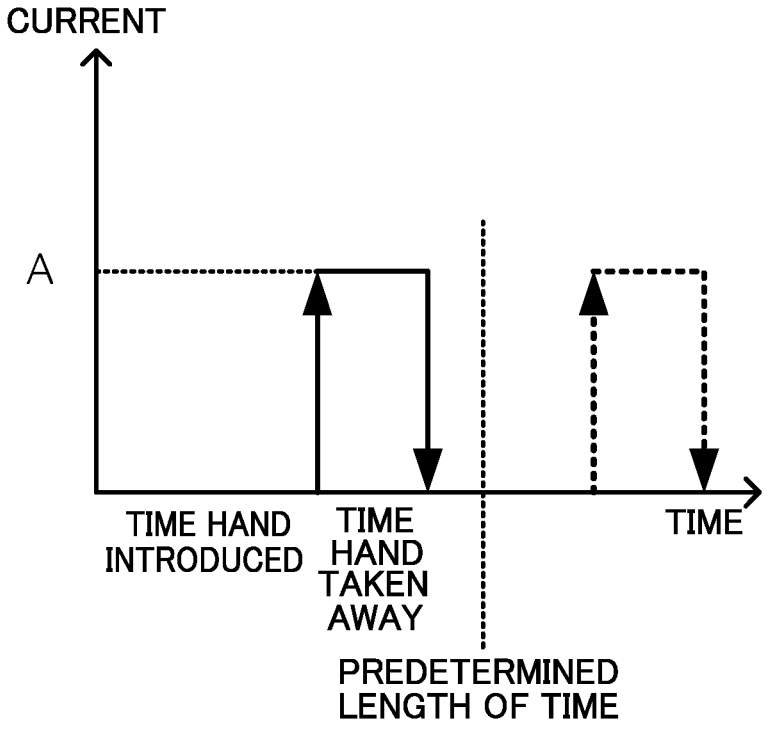
FIG. 4B is a diagram illustrating an example of detection values in a case in which the length of time that a handle sensor detects the hand of an operator is less than a predetermined length of time.

For example, as illustrated in FIG. 4B, the control device 12 detects a first operation in cases in which the length of time that the handle sensor 20 detects the hand of an operator is less than a predetermined length of time. In cases in which the first operation has been detected when the lock of the vehicle door 30 is in a locked state, the control device 12 actuates the door lock actuation section 18 so as to unlock the vehicle door 30. Note that in the present exemplary embodiment, the door locks of all vehicle doors 30 are unlocked in cases in which the first operation has been detected.

Further, as illustrated in FIG. 4A, the control device 12 detects a second operation in cases in which the handle sensor 20 continuously detects the hand of an operator for at least a predetermined length of time after initially detecting the hand of the operator. In cases in which the second operation has been detected when the lock of vehicle door 30 is in an unlocked state, the control device 12 actuates the door latch actuation section 16 so as to release the door latch of the vehicle door 30 and open the vehicle door 30.

The control device 12 also detects a third operation in cases in which in which the length of time that the handle sensor 20 detects the hand of an operator is less than a predetermined length of time. Although this operation is the same as the first operation, the state of the lock differs. Namely, the third operation is deemed to be detected in cases in which an operation the same as the first operation has been detected but the lock of the vehicle door 30 is in an unlocked state. In cases in which the third operation has been detected when the lock of the vehicle door 30 is in the unlocked state, the control device 12 actuates the door lock actuation section 18 so as to lock the lock of the vehicle door 30. Thus having the third operation be the same as the first operation simplifies lock control and enables door locks to be placed into a locked state by an easy-to-understand operation.

The control device 12 further detects a fourth operation in cases in which the handle sensor 20 continuously detects the hand of an operator for at least a predetermined length of time after initially detecting the hand of the operator. Although this operation is the same as the second operation, the state of the lock differs. Namely, the fourth operation is deemed to be detected in cases in which an operation the same as the second operation has been detected but the lock of the vehicle door 30 is in a locked state. In cases in which the fourth operation has been detected when the lock of the vehicle door 30 is in a locked state, the control device 12 actuates the door lock actuation section 18 so as to unlock the lock of the vehicle door 30, and actuates the door latch actuation section 16 so as to release the door latch of the vehicle door 30 and open the vehicle door 30. Note that when unlocking the lock, the door lock actuation sections 18 of all vehicle doors 30 are actuated so as to unlock the respective locks.

Figure 5:
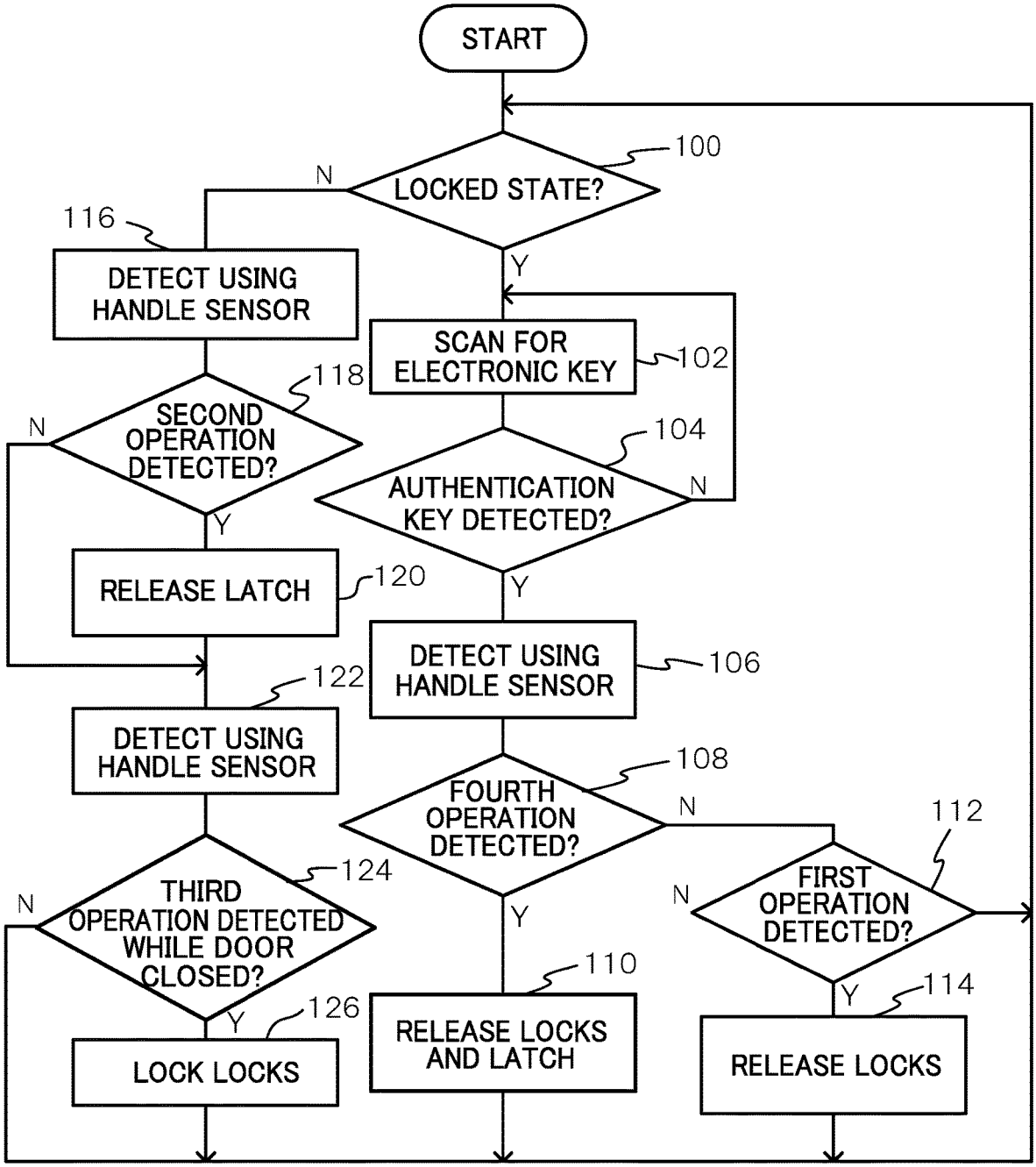
FIG. 5 is a flowchart illustrating an example flow of door opening/closing control performed by a control device of a vehicle door opening/closing control device according to the first exemplary embodiment.

Explanation follows regarding the specific processing performed by the control device 12 of the vehicle door opening/closing control device 10 according to the present exemplary embodiment, configured as described above. FIG. 5 is a flowchart illustrating an example flow of door opening/closing control performed by the control device 12 of the vehicle door opening/closing control device 10 according to the present exemplary embodiment. Note that the processing of FIG. 5 relates to an example that focuses on operations related to the opening/closing of a vehicle door 30 from outside the vehicle, and processing such as for lock operations from inside the vehicle is omitted therefrom.

At step 100, the CPU 12A makes a determination as to whether or not the vehicle door 30 is in a locked state. Here, for example, a determination is made as to whether or not the lock of the vehicle door 30 is locked based on the actuation state of the door lock actuation section 18. Alternatively, a lock sensor, switch, or the like may be provided in order to determine a locked state. Processing transitions to step 102 in cases in which determination is affirmative, and processing transitions to step 116 in cases in which determination is negative.

At step 102, the CPU 12A scans for an electronic key 15, and then processing transitions to step 104. Namely, the authentication section 14 searches for an electronic key 15 held by an operator.

At step 104, the CPU 12A makes a determination as to whether or not an authentication key has been detected. Here, a determination is made as to whether or not a pre-registered electronic key 15 has been detected by the authentication section 14. Processing transitions to step 106 in cases in which determination is affirmative. In cases in which determination is negative, processing returns to step 102 and the processing described above repeats.

At step 106, the CPU 12A performs operator hand detection using the handle sensor 20 and then processing transitions to step 108.

At step 108, the CPU 12A makes a determination as to whether or not the fourth operation has been detected. Here, a determination is made as to whether or not after initially detecting the hand of the operator, the handle sensor 20 continuously detected the hand of the operator for at least a predetermined length of time. Processing transitions to step 110 in cases in which determination is affirmative, and processing transitions to step 112 in cases in which determination is negative.

At step 110, the CPU 12A actuates the door lock actuation sections 18 so as to unlock the locks of all of the vehicle doors 30, and actuates the door latch actuation section 16 of the vehicle door 30 on which the hand of the operator was detected so as to release this door latch and open the vehicle door 30, after which processing returns to step 100 and the processing described above repeats.

At step 112, the CPU 12A makes a determination as to whether or not the first operation has been detected. Here, a determination is made as to whether or not the length of time that the handle sensor 20 detected the hand of the operator after initially detecting the hand of an operator is less than the predetermined length of time. Processing transitions to step 114 in cases in which determination is affirmative. In cases in which determination is negative, processing returns to step 100 and the processing described above repeats.

At step 114, the CPU 12A actuates the door lock actuation sections 18 so as to unlock the locks of all of the vehicle doors 30, after which processing returns to step 100 and the processing described above repeats.

At step 116, the CPU 12A performs operator hand detection using the handle sensor 20 and then processing transitions to step 118.

At step 118, the CPU 12A makes a determination as to whether or not the second operation has been detected. Here, a determination is made as to whether or not after initially detecting the hand of an operator, the handle sensor 20 continuously detected the hand of the operator for at least the predetermined length of time. Processing transitions to step 120 in cases in which determination is affirmative, and processing transitions to step 122 in cases in which determination is negative.

At step 120, the CPU 12A actuates the door latch actuation section 16 so as to release the door latch and open the vehicle door 30, and then processing transitions to step 122.

At step 122, the CPU 12A performs operator hand detection using the handle sensor 20 and then processing transitions to step 124.

At step 124, the CPU 12A makes a determination as to whether or not the third operation has been detected. Here, a determination is made as to whether or not after initially detecting the hand of an operator, the handle sensor 20 continuously detected the hand of the operator for at least the predetermined length of time. Processing transitions to step 126 in cases in which determination is affirmative. In cases in which determination is negative, processing returns to step 100 and the processing described above repeats.

At step 126, the CPU 12A actuates the door lock actuation sections 18 so as to lock the locks of all of the vehicle doors 30, after which processing returns to step 100 and the processing described above repeats.

Such control by the control device 12 enables door latches to be controlled separately to door locks based on detection results from a single handle sensor 20.

Further, providing the handle sensor 20 to an outside handle 32 enables a smooth transition to an opening/closing operation of the vehicle door 30 after unlocking the door locks.

Second Exemplary Embodiment

Figure 6:
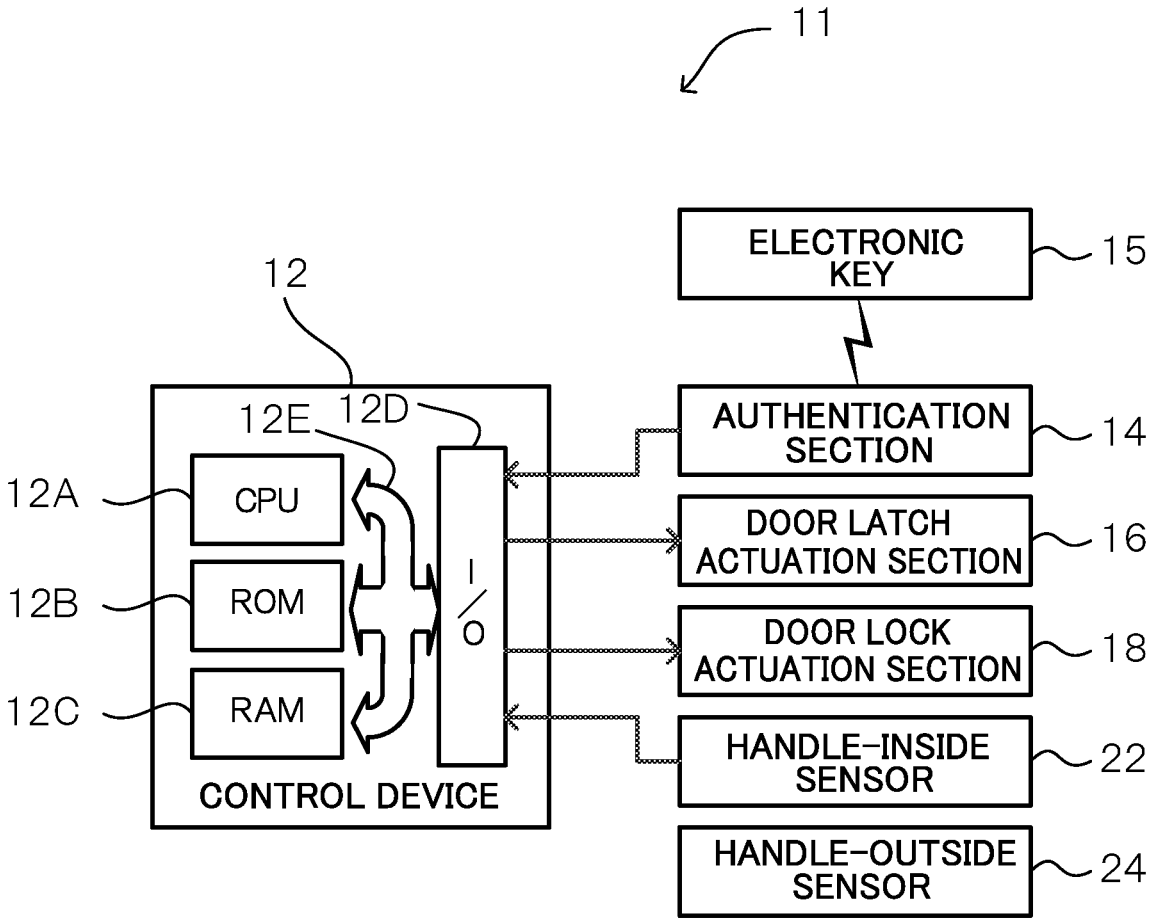
FIG. 6 is a block diagram illustrating the schematic configuration of a vehicle door opening/closing control device according to a second exemplary embodiment.

Next, explanation follows regarding a vehicle door opening/closing control device according to a second exemplary embodiment. FIG. 6 is a block diagram illustrating the schematic configuration of a vehicle door opening/closing control device 11 according to the present exemplary embodiment.

In the previous exemplary embodiment, a single handle sensor 20 is used to detect plural operations and the door locks are controlled separately to the door latches. However, the present exemplary embodiment includes two handle sensors. Namely, as illustrated in FIG. 6, the present exemplary embodiment is configured similarly to the previous exemplary embodiment except for that instead of the handle sensor 20, a handle-inside sensor 22, serving as a latch instruction section, and a handle-outside sensor 24, serving as a lock instruction section, are provided.

Figure 7A:
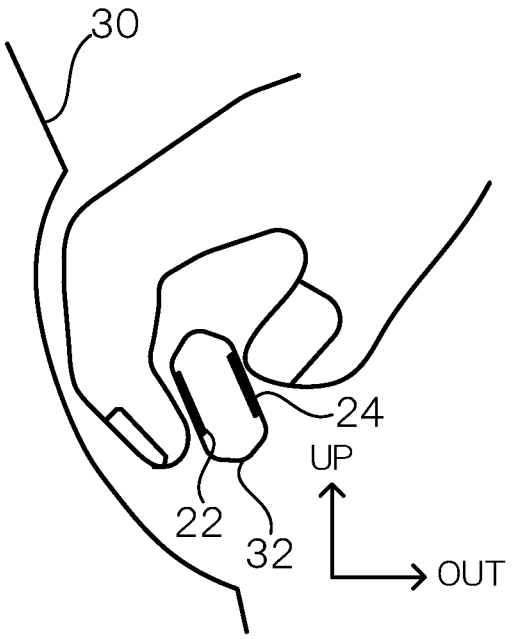
FIG. 7A is a cross-section illustrating a handle-inside sensor and a handle-outside sensor provided to an outside handle.

As illustrated in FIG. 7A, the handle-inside sensor 22 is provided at the vehicle inner side of an outside handle 32, and the handle-outside sensor 24 is provided at the vehicle outer side of the outside handle 32. Sensors similar to that employed for the handle sensor 20 in the previous exemplary embodiment may be employed as the handle-inside sensor 22 and the handle-outside sensor 24.

Figure 7B:
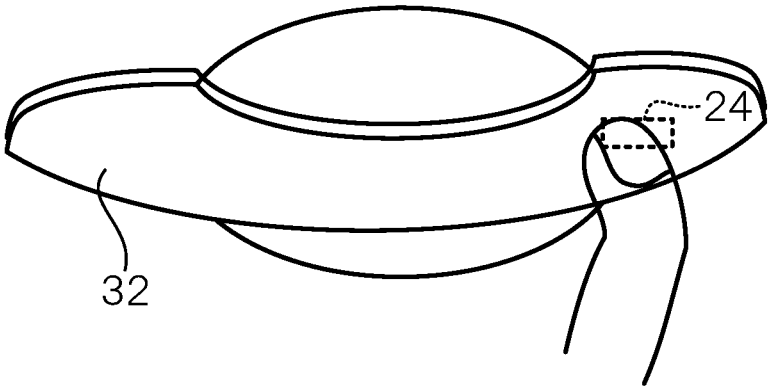
FIG. 7B is a diagram illustrating an example placement for a handle-outside sensor.

As illustrated in FIG. 7A, the handle-outside sensor 24 may be positioned at positions such that both the handle-inside sensor 22 and the handle-outside sensor 24 are able to be grasped and operated by an operator, or as illustrated in FIG. 7B, the handle-outside sensor 24 may be provided near a vehicle front or vehicle rear attachment point of the outside handle 32.

The control device 12 performs lock control to actuate the door lock actuation sections 18 and latch control to actuate the door latch actuation sections 16 based on detection results from the handle-inside sensor 22 and the handle-outside sensor 24.

Specifically, the control device 12 detects a first operation in cases in which the handle-outside sensor 24 detects the hand of an operator and the lock of the vehicle door 30 is in a locked state. When the first operation has been detected, the control device 12 actuates the door lock actuation section 18 so as to unlock the door lock of the vehicle door 30.

The control device 12 detects a second operation in cases in which the handle-inside sensor 22 detects the hand of an operator and the lock of the vehicle door 30 is in an unlocked state. When the second operation has been detected, the control device 12 actuates the door latch actuation section 16 so as to release the door latch of the vehicle door 30 and allow the vehicle door 30 to be opened.

The control device 12 detects a third operation in cases in which the handle-outside sensor 24 detects the hand of an operator and the lock of the vehicle door 30 is in an unlocked state. When the third operation has been detected, the control device 12 actuates the door lock actuation section 18 so as to lock the lock of the vehicle door 30.

The control device 12 detects a fourth operation in cases in which both the handle-inside sensor 22 and the handle-outside sensor 24 detect the hand of an operator and the lock of the vehicle door 30 is in a locked state. When the fourth operation has been detected, the control device 12 actuates the door lock actuation section 18 so as to lock the lock of the vehicle door 30, and the door latch actuation section 16 releases the door latch of the vehicle door 30 and opens the vehicle door 30.

Figure 8:
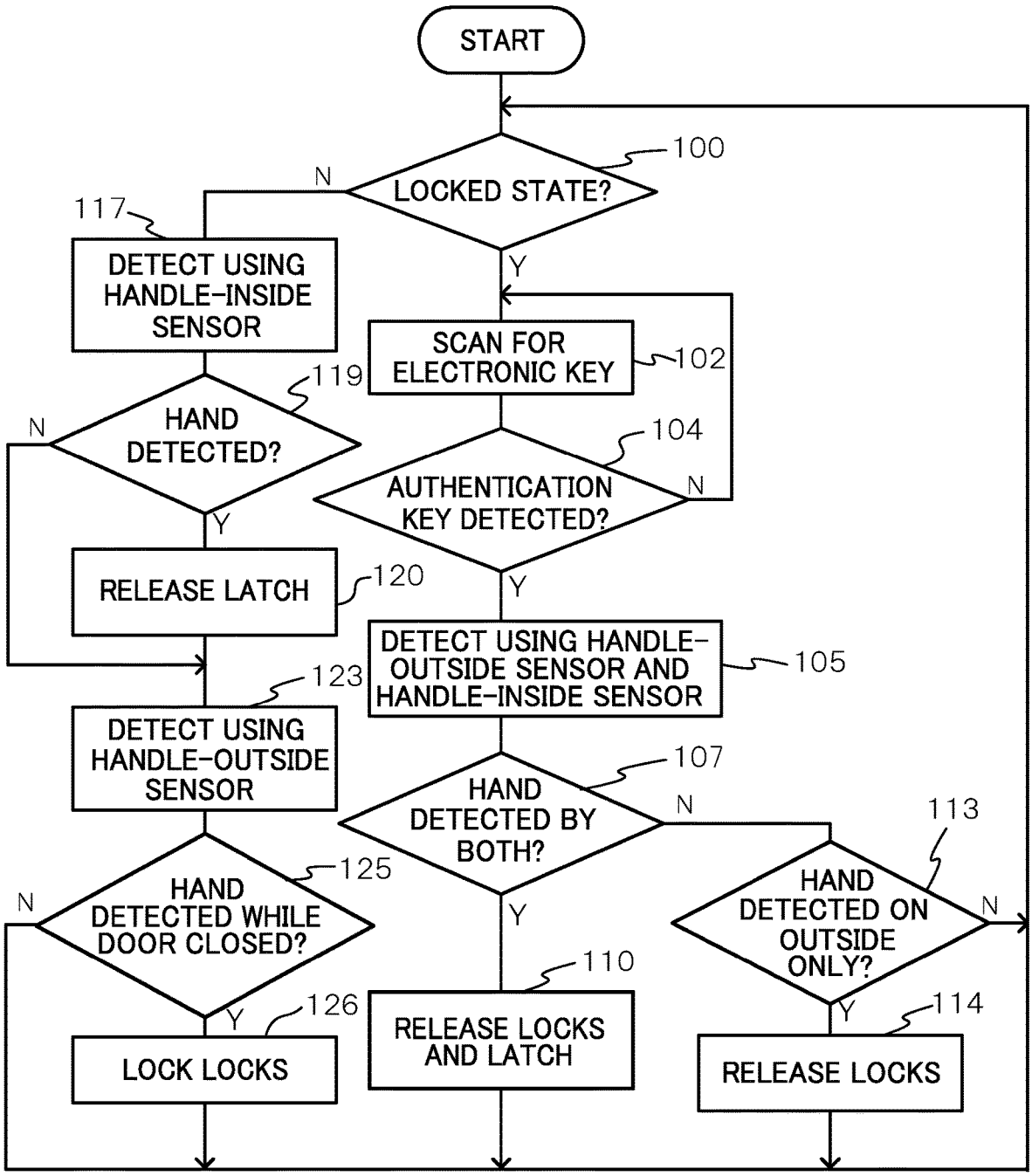
FIG. 8 is a flowchart illustrating an example flow of door opening/closing control performed by a control device of a vehicle door opening/closing control device according to the second exemplary embodiment.

Explanation follows regarding the specific processing performed by the control device 12 of the vehicle door opening/closing control device 11 according to the present exemplary embodiment, configured as described above. FIG. 8 is a flowchart illustrating an example flow of door opening/closing control performed by the control device 12 of the vehicle door opening/closing control device 11 according to the present exemplary embodiment. Note that the processing of FIG. 8 relates to an example that focuses on operations related to the opening/closing of a vehicle door 30 from outside the vehicle, and processing such as for lock operations from inside the vehicle is omitted therefrom. Note that processing that is the same as that of the previous exemplary embodiment is explained using the same reference numerals.

At step 100, the CPU 12A makes a determination as to whether or not the vehicle door 30 is in a locked state. Here, for example, a determination is made as to whether or not the lock of the vehicle door 30 is locked based on the actuation state of the door lock actuation section 18. Alternatively, a lock sensor, switch, or the like may be provided in order to determine a locked state. Processing transitions to step 102 in cases in which determination is affirmative, and processing transitions to step 117 in cases in which determination is negative.

At step 102, the CPU 12A scans for an electronic key 15, and then processing transitions to step 104. Namely, the authentication section 14 searches for an electronic key 15 held by an operator.

At step 104, the CPU 12A makes a determination as to whether or not an authentication key has been detected. Here, a determination is made as to whether or not a pre-registered electronic key 15 has been detected by the authentication section 14. Processing transitions to step 105 in cases in which determination is affirmative. In cases in which determination is negative, processing returns to step 102 and the processing described above repeats.

At step 105, the CPU 12A performs operator hand detection using the handle-inside sensor 22 and the handle-outside sensor 24 and then processing transitions to step 107.

At step 107, the CPU 12A makes a determination as to whether or not the hand of an operator has been detected by both the handle-inside sensor 22 and the handle-outside sensor 24. Namely, the CPU 12A makes a determination as to whether or not the fourth operation has been detected. Processing transitions to step 110 in cases in which determination is affirmative, and processing transitions to step 113 in cases in which determination is negative.

At step 110, the CPU 12A actuates the door lock actuation sections 18 so as to unlock the locks of all of the vehicle doors 30, and actuates the door latch actuation section 16 of the vehicle door 30 on which the hand of the operator was detected so as to release this door latch and open the vehicle door 30, after which processing returns to step 100 and the processing described above repeats.

At step 113, the CPU 12A makes a determination as to whether or not the hand of an operator was only detected by the handle-outside sensor 24. Namely, the CPU 12A makes a determination as to whether or not the first operation has been detected. Processing transitions to step 114 in cases in which determination is affirmative. In cases in which determination is negative, processing returns to step 100 and the processing described above repeats.

At step 114, the CPU 12A actuates the door lock actuation sections 18 so as to unlock the locks of all of the vehicle doors 30, after which processing returns to step 102 and the processing described above repeats.

At step 117, the CPU 12A performs operator hand detection using the handle-inside sensor 22 and then processing transitions to step 119.

At step 119, the CPU 12A makes a determination as to whether or not the hand of an operator was detected by the handle-inside sensor 22. Namely, the CPU 12A makes a determination as to whether or not the second operation has been detected. Processing transitions to step 120 in cases in which determination is affirmative, and processing transitions to step 123 in cases in which determination is negative.

At step 120, the CPU 12A actuates the door latch actuation section 16 so as to release the door latch and open the vehicle door 30, and then processing transitions to step 123.

At step 123, the CPU 12A performs operator hand detection using the handle-outside sensor 24 and then processing transitions to step 125.

At step 125, the CPU 12A makes a determination as to whether or not the hand of an operator was detected by the handle-outside sensor 24. Namely, the CPU 12A makes a determination as to whether or not the third operation has been detected. Processing transitions to step 126 in cases in which determination is affirmative. In cases in which determination is negative, processing returns to step 100 and the processing described above repeats.

At step 126, the CPU 12A actuates the door lock actuation sections 18 so as to lock the locks of all of the vehicle doors 30, after which processing returns to step 100 and the processing described above repeats.

Such control enables door latches to be controlled separately to door locks based on detection results from two handle sensors (the handle-inside sensor 22 and the handle-outside sensor 24).

Note that as in the first exemplary embodiment, the handle-inside sensor 22 and the handle-outside sensor 24 of the present exemplary embodiment may each be configured to detect plural operations according to operation time lengths.

Third Exemplary Embodiment

Next, explanation follows regarding a vehicle door opening/closing control device according to a third exemplary embodiment. This is a modified example of the first exemplary embodiment.

In the first exemplary embodiment, the door lock actuation sections 18 of all vehicle doors 30 are actuated so as to unlock the door locks in cases in which the first operation is detected when the door locks are in a locked state. However, in the present exemplary embodiment, in cases in which the first operation is detected when the door locks are in a locked state, only the door lock of the vehicle door 30 corresponding to the handle sensor 20 that detected a hand is unlocked.

Further, in the present exemplary embodiment, as illustrated by the dashed line in FIG. 2B, a fifth operation is detected in cases in which successive first operations are detected or in cases in which another first operation is detected after one of the door locks has been unlocked by a first operation. In cases in which the fifth operation is detected, the control device 12 actuates the door lock actuation sections 18 of all vehicle doors 30 so as to release the locks.

Figure 9:
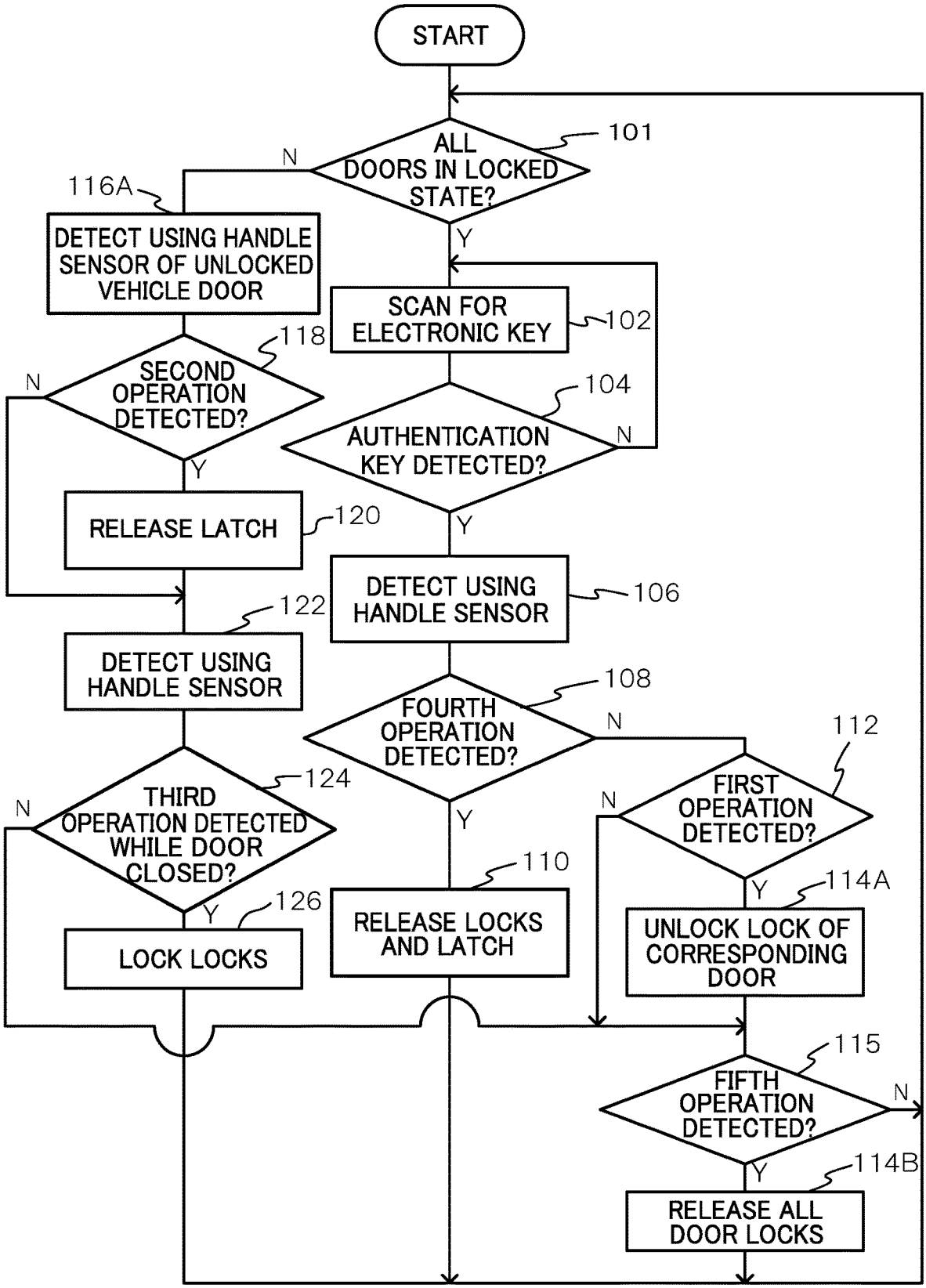
FIG. 9 is a flowchart illustrating an example flow of door opening/closing control performed by a control device of a vehicle door opening/closing control device according to a third exemplary embodiment.

Explanation follows regarding the specific processing performed by the control device 12 of the vehicle door opening/closing control device according to the present exemplary embodiment. FIG. 9 is a flowchart illustrating an example flow of door opening/closing control performed by the control device 12 of the vehicle door opening/closing control device according to the present exemplary embodiment. Note that processing that is the same as that in FIG. 5 is explained using the same reference numerals.

At step 101, the CPU 12A makes a determination as to whether or not the vehicle doors 30 are all in a locked state. Here, for example, a determination is made as to whether or not the locks of the vehicle doors 30 are all locked based on the actuation states of the door lock actuation sections 18. Alternatively, lock sensors, switches, or the like may be provided in order to determine locked states. Processing transitions to step 102 in cases in which determination is affirmative, and processing transitions to step 116A in cases in which determination is negative.

At step 102, the CPU 12A scans for an electronic key 15, and then processing transitions to step 104. Namely, the authentication section 14 searches for an electronic key 15 held by an operator.

At step 104, the CPU 12A makes a determination as to whether or not an authentication key has been detected. Here, a determination is made as to whether or not a pre-registered electronic key 15 has been detected by the authentication section 14. Processing transitions to step 106 in cases in which determination is affirmative. In cases in which determination is negative, processing returns to step 102 and the processing described above repeats.

At step 106, the CPU 12A performs operator hand detection using the handle sensor 20 and then processing transitions to step 108.

At step 108, the CPU 12A makes a determination as to whether or not the fourth operation has been detected. Here, a determination is made as to whether or not after initially detecting the hand of the operator, the handle sensor 20 continuously detected the hand of the operator for at least a predetermined length of time. Processing transitions to step 110 in cases in which determination is affirmative, and processing transitions to step 112 in cases in which determination is negative.

At step 110, the CPU 12A actuates the door lock actuation sections 18 so as to unlock the locks of all of the vehicle doors 30, and actuates the door latch actuation section 16 of the vehicle door 30 for which the hand of the operator was detected by the handle sensor 20 so as to release this door latch and open the vehicle door 30, after which processing transitions to step 122. Note that in the present exemplary embodiment, at step 110, configuration may be such that only the lock of the vehicle door 30 for which the hand of an operator was detected by a handle sensor 20 is unlocked and has its door latch released.

At step 112, the CPU 12A makes a determination as to whether or not the first operation has been detected. Here, a determination is made as to whether or not the length of time that the handle sensor 20 detected the hand of the operator after initially detecting the hand of an operator is less than the predetermined length of time. Processing transitions to step 114A in cases in which determination is affirmative. In cases in which determination is negative, processing transitions to step 115.

At step 114A, the CPU 12A actuates the door lock actuation section 18 corresponding to the vehicle door 30 for which a handle sensor 20 detected the hand of an operator, so as to unlock its lock, after which processing transitions to step 115.

At step 115, the CPU 12A makes a determination as to whether or not the fifth operation has been detected. Here, a determination is made as to whether or not two operations for which the length of time the hand of an operator was detected was less than the predetermined length of time were detected in succession. Alternatively, a determination is made as to whether or not an additional first operation was detected after actuation of the door lock actuation section 18 in response to a first operation. Processing transitions to step 114B in cases in which determination is affirmative. In cases in which determination is negative, processing returns to step 101 and the processing described above repeats.

At step 114B, the CPU 12A actuates the door lock actuation sections 18 so as to unlock the locks of all of the vehicle doors 30, after which processing returns to step 101 and the processing described above repeats.

At step 116A, the CPU 12A performs operator hand detection using the handle sensor 20 of the unlocked vehicle door 30 and then processing transitions to step 118.

At step 118, the CPU 12A makes a determination as to whether or not the second operation has been detected. Here, a determination is made as to whether or not after initially detecting the hand of an operator, the handle sensor 20 continuously detected the hand of the operator for at least the predetermined length of time. Processing transitions to step 120A in cases in which determination is affirmative, and processing transitions to step 122 in cases in which determination is negative.

At step 120, the CPU 12A actuates the door latch actuation section 16 so as to release the door latch and open the vehicle door 30, and then processing transitions to step 122.

At step 122, the CPU 12A performs operator hand detection using the handle sensor 20 and then processing transitions to step 124.

At step 124, the CPU 12A makes a determination as to whether or not the third operation has been detected. Here, a determination is made as to whether or not after initially detecting the hand of an operator, the handle sensor 20 continuously detected the hand of the operator for at least the predetermined length of time. Processing transitions to step 126 in cases in which determination is affirmative. In cases in which determination is negative, processing transitions to step 115.

At step 126, the CPU 12A actuates the door lock actuation sections 18 so as to lock the locks of all of the vehicle doors 30, after which processing returns to step 101 and the processing described above repeats.

With such control by the control device 12, in contrast to the previous exemplary embodiments, it is possible to unlock only the lock of the vehicle door 30 corresponding to a handle sensor 20 that detected a hand. Such control also allows the unlocking of the door lock of a single vehicle door 30 to be performed separately to the unlocking of the door locks of all vehicle doors 30.

Note that in the first exemplary embodiment and the third exemplary embodiment, the third operation is the same as the first operation, and the first operation is distinguished from the third operation according to the lock state. However, there is no limitation thereto. For example, the third operation may be the same as the second operation (the hand of an operator being continuously detected for at least the predetermined length of time after initial detection of the hand of an operator by the handle sensor 20).

Further, as in the third exemplary embodiment, the second exemplary embodiment may be configured such that in cases in which the handle-outside sensor 24 has detected the hand of an operator a first time (a door lock unlock operation), only the vehicle door 30 provided with the handle-outside sensor 24 that detected the hand of the operator is unlocked. Configuration may further be such that in cases in which a second door lock unlock operation is performed, the door locks of all vehicle doors 30 are unlocked.

Further, although plural operations are detected according to a length of time a hand of an operator is detected in the first exemplary embodiment and the third exemplary embodiment, there is no limitation thereto, and configuration may be such that plural operations are detected using a number of times that a hand of an operator is detected. Alternatively, configuration may be such that plural operations are detected using a combination of detection time length and a number of detections. Alternatively, in cases in which a pressure sensor is employed as the detection section, plural operations may be detected using operation force, or plural operations may be detected using a combination of detection time length, number of detections, and operation force.

Further, although the exemplary embodiments above are described using examples in which a handle sensor 20, handle-inside sensor 22, or handle-outside sensor 24 is provided to the outside handle 32 of a vehicle door 30, there is no limitation thereto, and a handle sensor 20, handle-inside sensor 22, or handle-outside sensor 24 may be provided to a part of a vehicle body other than a door.

Further, the processing performed by the control device 12 in the exemplary embodiments above may be software-based processing performed by executing a program, or may be processing performed by hardware. Alternatively, a combination of software-based processing and hardware-based processing may be employed. In cases in which the processing is software-based, the program may be stored and distributed using various storage media.

The present disclosure is not limited to the above configurations, and obviously various other modifications may be implemented within a range not departing from the spirit of the present disclosure.

What is claimed is:

1. A vehicle door opening and closing control device comprising:

a door lock actuation section that actuates a door lock;

a door latch actuation section that actuates a door latch;

an authentication section that authenticates an electronic key of an operator;

a lock instruction section that detects at least one of an approach of or contact by a hand of the operator and that instructs actuation of the door lock;

a latch instruction section that is provided separately from the lock instruction section, that detects at least one of the approach of or contact by the hand of the operator, and that instructs actuation of the door latch; and a controller that:

performs lock control so as to actuate the door lock actuation section in accordance with instruction from the lock instruction section in cases in which a pre-registered electronic key has been authenticated by the authentication section, and performs latch control so as to actuate the door latch actuation section in accordance with instruction from the latch instruction section in cases in which the door lock is in an unlocked state.

2. A vehicle door opening and closing control device comprising:

a door lock actuation section that actuates a door lock;

a door latch actuation section that actuates a door latch;

an authentication section that authenticates an electronic key of an operator;

a detection section that detects an operation according to at least one of contact by or an approach of a hand of the operator; and a controller that:

performs control so as to actuate the door lock actuation section and unlock the door lock in cases in which the door lock is in a locked state, a pre-registered electronic key has been authenticated by the authentication section, and a predetermined first operation has been detected based on a detection result from the detection section, and performs control so as to actuate the door latch actuation section and release the door latch in cases in which the door lock is in an unlocked state, and a predetermined second operation has been detected based on a detection result from the detection section.

3. The vehicle door opening and closing control device of claim 2, wherein:

the controller further performs control so as to actuate the door lock actuation section and lock the door lock in cases in which the door lock is in an unlocked state and a predetermined third operation has been detected based on a detection result from the detection section.

4. The vehicle door opening and closing control device of claim 3, wherein:

the controller further performs control so as to actuate the door lock actuation section and unlock the door lock, and so as to actuate the door latch actuation section and release the door latch, in cases in which the door lock is in a locked state, a pre-registered electronic key has been authenticated by the authentication section, and a predetermined fourth operation has been detected based on a detection result from the detection section.

5. The vehicle door opening and closing control device of claim 3, wherein:

in cases in which the door lock is in a locked state, a pre-registered electronic key has been authenticated by the authentication section, and the first operation has been detected, the controller performs control so as to actuate the door lock actuation section of a vehicle door where the detection section that detected the first operation is provided and unlock the door lock, and in cases in which the door lock is in a locked state, a pre-registered electronic key has been authenticated by the authentication section, and a predetermined fifth operation has been detected, the controller performs control so as to actuate the door lock actuation sections of all vehicle doors and unlock the door locks.

6. The vehicle door opening and closing control device of claim 3, wherein the detection section is provided at an outside handle.

7. The vehicle door opening and closing control device of claim 3, wherein:

the third operation is the same as the first operation or the second operation.

8. The vehicle door opening and closing control device of claim 7, wherein:

the controller further performs control so as to actuate the door lock actuation section and unlock the door lock, and so as to actuate the door latch actuation section and release the door latch, in cases in which the door lock is in a locked state, a pre-registered electronic key has been authenticated by the authentication section, and a predetermined fourth operation has been detected based on a detection result from the detection section.

9. The vehicle door opening and closing control device claim 7, wherein:

in cases in which the door lock is in a locked state, a pre-registered electronic key has been authenticated by the authentication section, and the first operation has been detected, the controller performs control so as to actuate the door lock actuation section of a vehicle door where the detection section that detected the first operation is provided and unlock the door lock, and in cases in which the door lock is in a locked state, a pre-registered electronic key has been authenticated by the authentication section, and a predetermined fifth operation has been detected, the controller performs control so as to actuate the door lock actuation sections of all vehicle doors and unlock the door locks.

10. The vehicle door opening and closing control device of claim 7, wherein the detection section is provided at an outside handle.

11. The vehicle door opening and closing control device of claim 2, wherein:

the controller further performs control so as to actuate the door lock actuation section and unlock the door lock, and so as to actuate the door latch actuation section and release the door latch, in cases in which the door lock is in a locked state, a pre-registered electronic key has been authenticated by the authentication section, and a predetermined fourth operation has been detected based on a detection result from the detection section.

12. The vehicle door opening and closing control device of claim 2, wherein:

in cases in which the door lock is in a locked state, a pre-registered electronic key has been authenticated by the authentication section, and the first operation has been detected, the controller performs control so as to actuate the door lock actuation section of a vehicle door where the detection section that detected the first operation is provided and unlock the door lock, and in cases in which the door lock is in a locked state, a pre-registered electronic key has been authenticated by the authentication section, and a predetermined fifth operation has been detected, the controller performs control so as to actuate the door lock actuation sections of all vehicle doors and unlock the door locks.

13. The vehicle door opening and closing control device of claim 2, wherein the detection section is provided at an outside handle.

* * * * *